US006348072B1

(12) United States Patent
Vetter

(10) Patent No.: US 6,348,072 B1
(45) Date of Patent: Feb. 19, 2002

(54) HEAT SETTING CHAMBER ARRANGEMENT AND USE OF SAME TO MAKE TEXTURED YARN

(75) Inventor: Gerhard Vetter, Suessen (DE)

(73) Assignee: Michael Hoerauf Maschinenfabrik GmbH & Co. KG, Donzdorf (DE)

( * ) Notice: Subject to any disclaimer, the term of this patent is extended or adjusted under 35 U.S.C. 154(b) by 0 days.

(21) Appl. No.: 09/417,118

(22) Filed: Oct. 13, 1999

(30) Foreign Application Priority Data

Nov. 11, 1998 (DE) ..... 198 51 923

(51) Int. Cl.[7] ..... D06B 3/04; B65H 51/24

(52) U.S. Cl. ..... 8/149.3; 28/281; 34/625; 242/366.2; 68/5 D

(58) Field of Search ..... 8/149.3; 68/5 D; 34/625; 242/366.2, 365.5, FOR 172, FOR 173; 57/282; 28/247, 278, 281

(56) References Cited

U.S. PATENT DOCUMENTS 3,426,553 A * 2/1969 Erb ..... 68/5 D
3,683,650 A 8/1972 Hirschburger
3,774,384 A * 11/1973 Richter ..... 68/5 D X
4,277,867 A * 7/1981 Lucke ..... 68/5 D X
4,414,756 A * 11/1983 Simpson et al. ..... 68/5 D X
5,522,161 A * 6/1996 Vetter ..... 68/5 D X
5,557,862 A * 9/1996 Vetter et al. ..... 34/265 X
5,588,604 A * 12/1996 Vetter et al. ..... 242/366.2

* cited by examiner

*Primary Examiner*—Philip R. Coe
(74) *Attorney, Agent, or Firm*—Crowell & Moring LLP

(57) ABSTRACT

An arrangement for transporting yarn through a heat setting chamber has a rotatably driven central mast which is equipped with transport belts arranged around the mast in the form of a polygon in cross section. At least one yarn is wound around the transport belts in loops by means of a winding flyer. At the latest when arriving at the heat setting chamber, the loops should have a larger circumference than the polygon formed by the transport belts for the purpose of forming a shrinkage reserve. This is achieved in that auxiliary belts, ending upstream of the heat setting chamber, are arranged in the area of the winding flyer, the speed of which auxiliary belts corresponds to the speed of the transport belts and which enlarge the polygon to the amount of the desired shrinkage reserve.

40 Claims, 5 Drawing Sheets

IIIa
IIIb
A
B
1
2
3
4
5
9
10
11
12
13
15
16
17
20
21
22

37
12
14
38
11
13
35
32
34
31
33
36
IV
IV
39
3
17
16
4
23
26
5
15
9
III
III
A
27
29
10

37
12
14
38
11
13
35
32
34
31
33
36
3
39
43
40
5
41
42
29
10
16
26
27
4
23
15
9
VI
A
VI

HEAT SETTING CHAMBER ARRANGEMENT AND USE OF SAME TO MAKE TEXTURED YARN

BACKGROUND AND SUMMARY OF THE INVENTION

This application claims the priority of German application 198 51 923.0, filed in Germany on Nov. 11, 1998, the disclosure of which is expressly incorporated by reference herein.

The present invention relates to an arrangement for transporting yarn through a heat setting chamber having a preferably rotatably driven central mast, which is fitted with a plurality of transport belts arranged in cross section around it in the form of a polygon, the transport belts being driven in transport direction, around which transport belts at least one yarn is wound in ordered loops by means of a winding flyer, which loops have, at the latest at arriving at the heat setting chamber, a larger circumference for the purpose of forming a shrinkage reserve than that of the polygon formed by the transport belts.

An arrangement of this type, also comprising a rotatably driven central mast, is prior art in U.S. Pat. No. 3,683,650. For the purpose of forming the desired shrinkage reserve, it is provided in this arrangement that the outer ends of the transport belts, before they run into the heat setting chamber, are guided step-like nearer up to the mast with the aid of guiding rollers, so that downstream of the guiding rollers in the area of the heat setting chamber, the loops of the yarn can hang freely on the upper ends of the transport belts and thus can shrink freely in the heat setting chamber. This type of formation of a shrinkage reserve loads the transport belts with an increased tension and results in a higher power consumption for the transport belt drive.

It is an object of the present invention to form a shrinkage reserve in an arrangement of the above mentioned type, which reserve is more favorable with regard to the loading of the transport belts and to power consumption.

This object has been achieved in accordance with the present invention in that auxiliary belts, ending upstream of the heat setting chamber, are arranged in the area of the winding flyer, the speed of which auxiliary belts corresponds to the speed of the transport belts, and which enlarge the polygon by the amount of the desired shrinkage reserve.

Due to the features according to the present invention, the transport belts are not additionally loaded for the purpose of forming a shrinkage reserve. While in prior art the polygon, formed by the transport belts, is reduced upstream of the heat setting chamber as a result of being pressed together, in the case of the present invention, a larger polygon is formed with the aid of the auxiliary belts, whereby before the loops of yarn reach the heat setting chamber, they are disposed subsequently on the polygon formed by the transport belts, whereby the desired shrinkage reserve occurs by itself.

The auxiliary belts can have a separate drive, which is adapted to the drive of the transport belts. In an advantageous embodiment of the present invention it is provided that driven guiding rollers are arranged for the transport belts, by means of which the auxiliary belts are also driven. This saves not only a separate drive for the auxiliary belts, but also ensures that the speed of the transport belts and of the auxiliary belts are absolutely identical.

If it is additionally desired that the central mast rotates slightly, the guiding rollers are advantageously arranged at a housing which rotates around the axis of the central mast.

This ensures that all areas of the yarn loops take up the same position one after the other and thus are reached in the same way by the heat setting medium located in the heat setting chamber.

A planetary gearing is provided for the rotating drive of the central mast. This does not, as in the case of prior art, consist of engaged toothed wheels, but rather comprises disc wheels having flat belts, by means of which the drive of the planetary gearing is simplified. This design is based on the knowledge that the central mast must in no way rotate in an exactly defined relation to the winding flyer, so no overly high demands are made on the exactness of the rotational drive.

BRIEF DESCRIPTION OF THE DRAWINGS

These and further objects, features and advantages of the present invention will become more readily apparent from the following detailed description thereof when taken in conjunction with the accompanying drawings wherein:

FIG. 3 is a cross section of the arrangement along the sectional plane III—III of FIG. 2, whereby in addition the loops disposed in sectional plane IIIa—IIIa and IIIb—IIIb of FIG. 1 are drawn in;

DETAILED DESCRIPTION OF THE DRAWINGS

Figure 1:
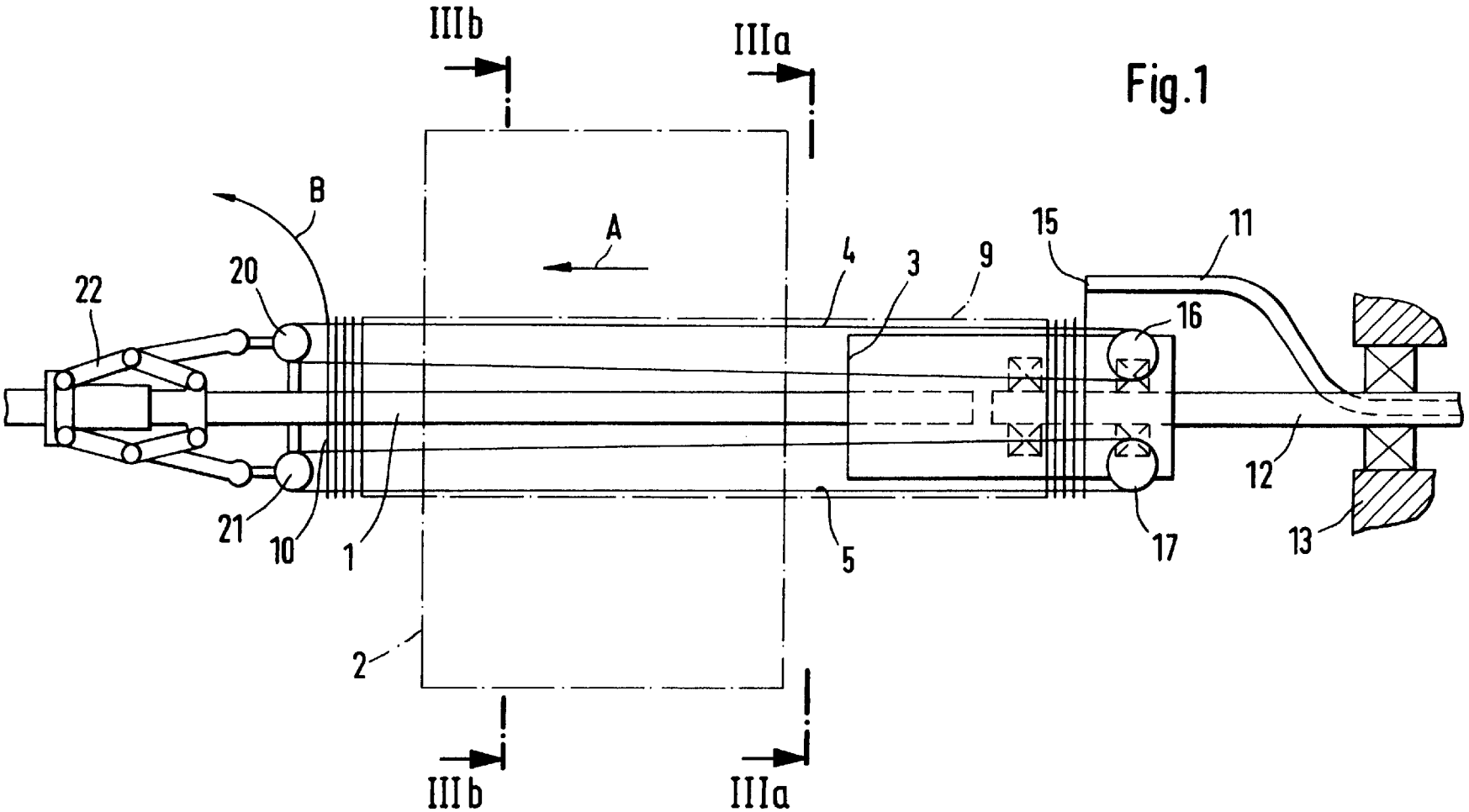
FIG. 1 is a side view of an arrangement for transporting yarn through a heat setting chamber.

Yarn heat setting installation shown schematically in FIG. 1 comprises a plurality, preferably four to six adjacently arranged central masts 1, of which in the side view of FIG. 1 only one central mast 1 is shown. Each central mast 1 is a component part of a transporting device, which is guided through a heat setting chamber 2, denoted only by a dot-dash line. The central mast 1 is supported at one end (in FIG. 1 at its right end) in a rotatable housing 3 which is described below in more detail, and at its other end either projects freely or is additionally supported from below by means of a supporting device (not shown).

Each central mast 1 is furnished with four transport belts 4,5,6 and 7 (see also FIG. 3), of which only two transport belts 4 and 5 are visible in FIG. 1. These transport belts 4 to 7, as can be seen clearly in FIG. 3 to be described below, are arranged as a polygon 8 around the central mast 1. They serve for the transport in transport direction A of at least one yarn 9, which is wound around the central mast 1 and the transport belts 4 to 7 in ordered loops. A plurality of yarns 9, preferably for example four or six, can be provided per central mast 1. This arrangement serves the purpose of transporting the greatest number of yarns 9 possible having a predetermined dwell time continuously through the heat setting chamber 2.

The depositing of the loops 10 takes place by means of a rotatable winding flyer 11, which is applied in the area of the supported end of the central mast 1 and is driven in a way not shown. The winding flyer 11 begins in a shaft 12 having an axial bore hole, which shaft 12 is supported in a stationary frame 13 coaxially to the central mast 1. The axial bore hole runs into a radial opening 14 of the shaft 12 (see also FIG. 2), so that the crank-like hollow winding flyer 11 can enter through it and be driven to rotational movements together with the shaft 12. The yarn 9 to be transported is fed in transport direction A through the axial bore hole and exits out of the mouth 15 of the winding flyer 11. Because of the rotational movement of the winding flyer 11, the yarn 9 is wound around the transport belts 4 to 7, which each preferably have a round cross section.

The housing 3 mentioned above is supported on the shaft 12, which housing 3 comprises the drive for the transport belts 4 to 7.

Figure 3:
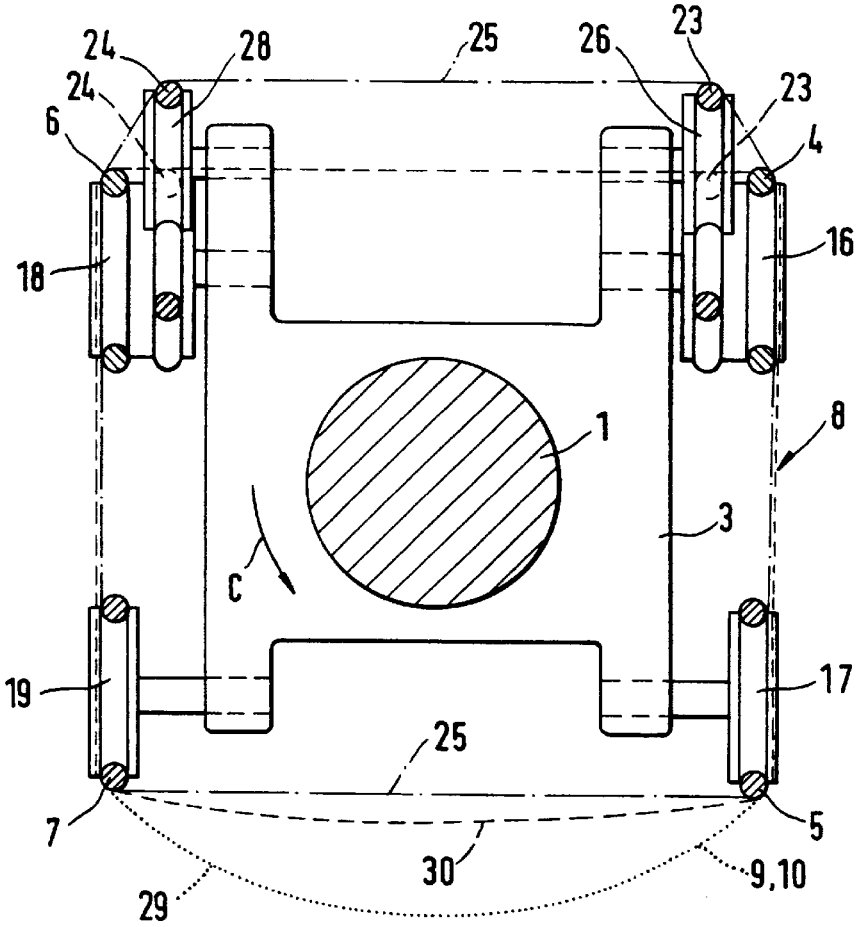

Driven upper and lower guiding rollers 16,17,18 and 19 are provided at the housing 3 for the transport belts 4 to 7 (see also FIG. 3). In the area of the freely projecting end of the central mast 1, freely rotatable upper and lower guiding rollers 20 and 21 for the transport belts 4 to 7 are arranged. Shortly before reaching the guiding rollers 20 and 21, the loops 10 of the yarn 9 are straightened out and withdrawn according to the arrow direction B, and in a way not shown, are guided to a winding machine. The guiding rollers 20 and 21 are arranged adjustably in distance to one another by means of a tension device 22.

If the loops 10, as described above, were wound closely around the transport belts 4 to 7, there would be the disadvantage that the yarns 9 could not freely shrink in the inside of the heat setting chamber 2, operating preferably with superheated steam. For this reason, it is provided by means of an additional device according to the present invention that, before reaching the heat setting chamber 2, a so-called shrinkage reserve 29 is formed, as described below with the aid of FIGS. 2 and 3.

In the area of the winding flyer 11 and upstream of the heat setting chamber 2, auxiliary belts 23 and 24 are applied at the housing 3, which belts 23 and 24 are driven at the same speed as the transport belts 4 to 7. The auxiliary transport belts 23 and 24 are also guided on the above mentioned driven guiding rollers 16 and 18, so that the desired speed is exactly ensured.

During winding of the loops 10 by means of rotation of the winding flyer 11, an enlarged polygon 25, differing from the polygon 8 formed upstream of the heat setting chamber 2 by the transport belts 4 to 7, is formed, as the auxiliary belts 23,24 lie with their upper ends above the transport belts 4 and 6. This is denoted by a dot-dash line in FIG. 3. During winding of the yarn 9 to the loops 10, which surround the transport belts 4 to 7 as well as the auxiliary belts 23 and 24, an at first closely disposed polygon 25 is formed.

The auxiliary belts 23 and 24, running over the driven guiding rollers 16 and 18 in the way described above, are in addition guided over freely rotating guiding rollers 26,27 and 28, which are also arranged at the housing 3. The additional belts 23 and 24 end at a distance before reaching the heat setting chamber 2.

Figure 2:
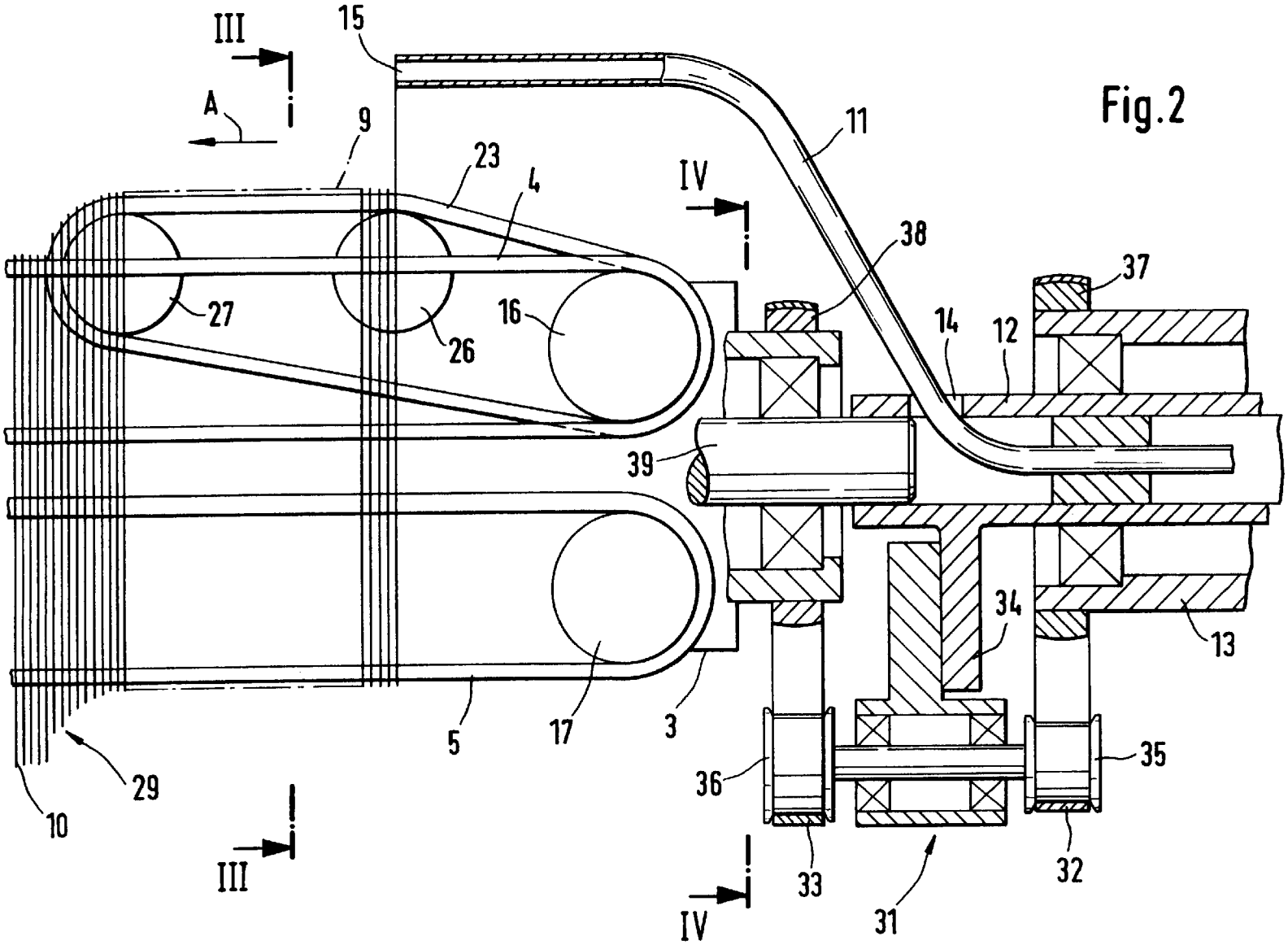
FIG. 2 is an enlarged view of an area of the arrangement located upstream of the heat setting chamber, constructed according to a preferred embodiment of the present invention.

When, as can be seen from FIG. 2, the loops 10 at the end of the auxiliary belts 23 and 24 slip down from same and land on the upper transport belts 4 and 6, they are then not closely disposed on the lower transport belts 5 and 7, but rather hang freely downwards.

This creates the desired shrinkage reserve 29, as shown in FIG. 3 by the dotted line, which reserve 29 permits the yarn 9 to shrink in the heat setting chamber 2 without being hindered by the tension generated by the transport belts 4 to 7.

As soon as the shrinking process is ended, the loops 10 approach the dot-dash line again from the dotted line, whereby, however, for reasons of caution, a pre-calculated small reserve 30 is retained, which is shown in FIG. 3 by means of a broken line. To explain FIG. 3 further it should be pointed out that the dot-dash line for the enlarged polygon lies in the sectional plane III—III of FIG. 2, the dotted line for the shrinkage reserve 29 lies in the sectional plane IIIa—IIIa of FIG. 1, and that after the completed shrinking process the rest reserve 30 lies in the sectional plane IIIb—IIIb of FIG. 1.

Figure 4:
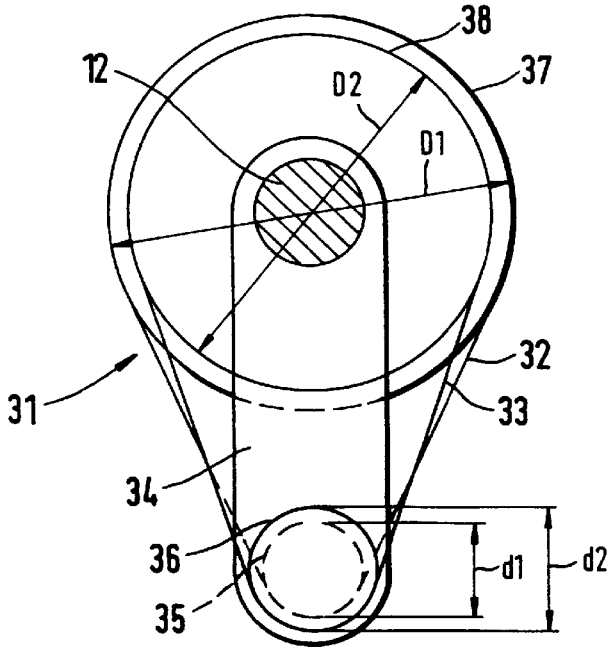
FIG. 4 is a schematic representation of the planetary gear in the area of the sectional plane IV—IV of FIG. 2.

As mentioned above, it is desirable, for the purposes of homogenizing the heat setting of the yarn 9, to permit the central mast I to rotate slowly. The arrangement provided for this purpose is described below with the aid of FIGS. 2 and 4.

The housing 3, in which the central mast 1 is supported, rotates slowly according to the arrow direction C shown in FIG. 3, namely around the axis of the central mast 1. The transporting belts 4 to 7 as well as the auxiliary belts 23 and 24 rotate with the housing 3, as the guiding rollers 16 to 19 as well as 26 to 28 are arranged at the housing 3. A planetary gearing 31 serves to generate this slow rotating movement, which planetary gearing 31 does not, as is usual, operate with toothed wheels, but rather in the present case, with flat belts 32 and 33. The planetary gearing 31 comprises a web 34, which is connected fixedly to the shaft 12 of the winding flyer 11 and thus is driven to rotate. Two planetary wheels 35 and 36, rotatably supported and connected fixedly to one another, are arranged at the web 34. The above mentioned flat belts 32 and 33 are arranged at the planetary wheels 35 and 36.

A non-rotating belt pulley 37, applied to the frame 13, is arranged at the planetary wheel 35. A belt pulley 38, connected affixedly to the rotatable housing 3, is arranged at the other planetary wheel 36, which belt pulley 38 is supported on an extension 39 of the shaft 12. This extension is coaxial to the central mast 1.

The diameter of the planetary wheels 35 and 36 as well as of the belt pulleys 37 and 38 are so chosen that when the winding flyer 11 rotates, the slow rotational movement of the central mast 1 takes place.

The diameter D1 of the belt pulley 37 is somewhat larger than the diameter D2 of the belt pulley 38. The diameter d1 of the planetary wheel 35, in contrast, is somewhat smaller than the diameter d2 of the other planetary wheel 36. As a result of the chosen diameters, the central mast 1 rotates slowly, as soon as the winding flyer 11 rotates.

If, on the one hand, the diameters D1 and D2 were the same, and, on the other hand, the diameters d1 and d2 were also equal, then the housing 3 would be non-rotating. In this case, however, the toothed belts are preferable to the flat belts 32 and 33.

Figure 5:
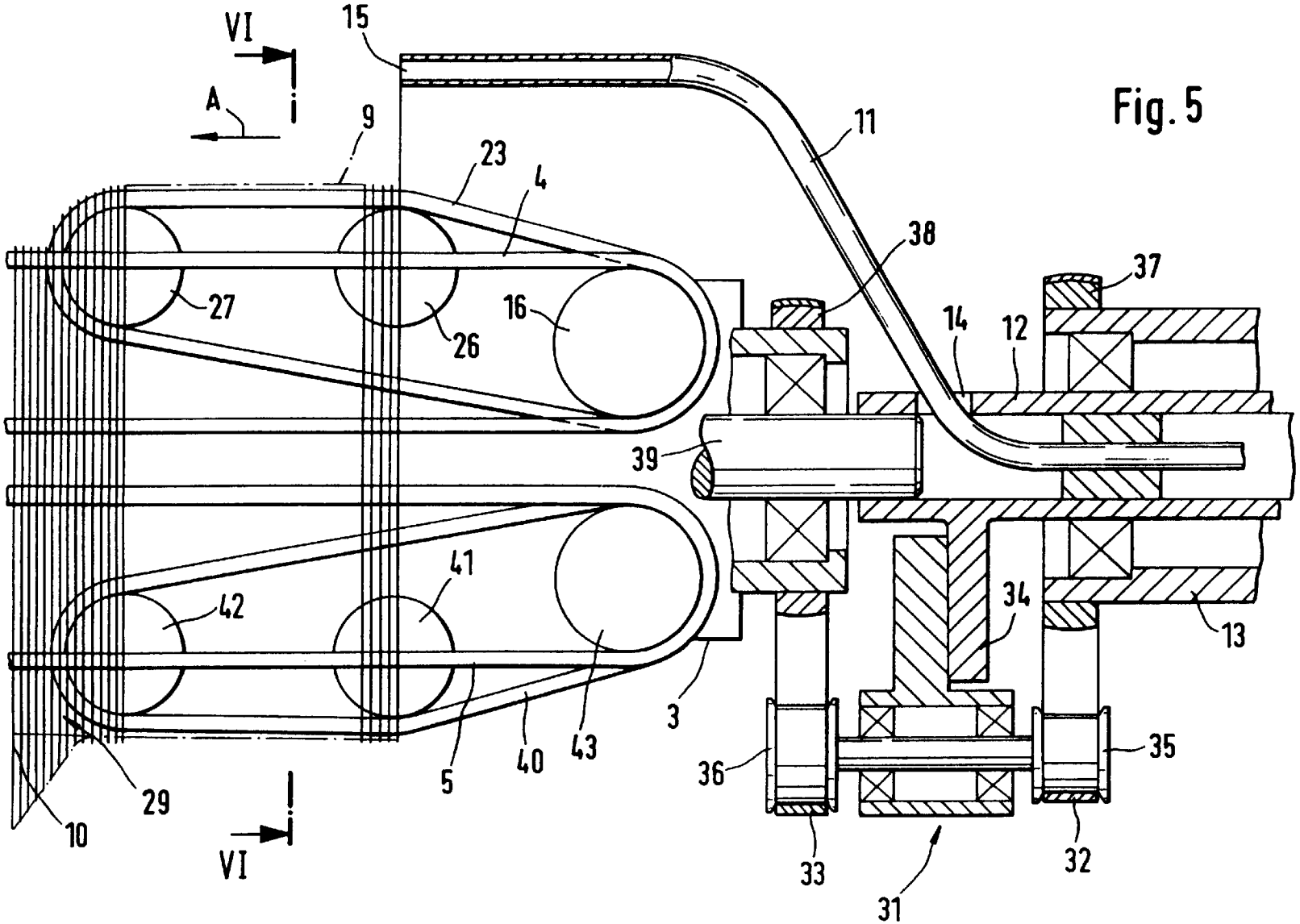
FIG. 5 is a representation similar to FIG. 2 showing another preferred embodiment of the present invention.
Figure 6:
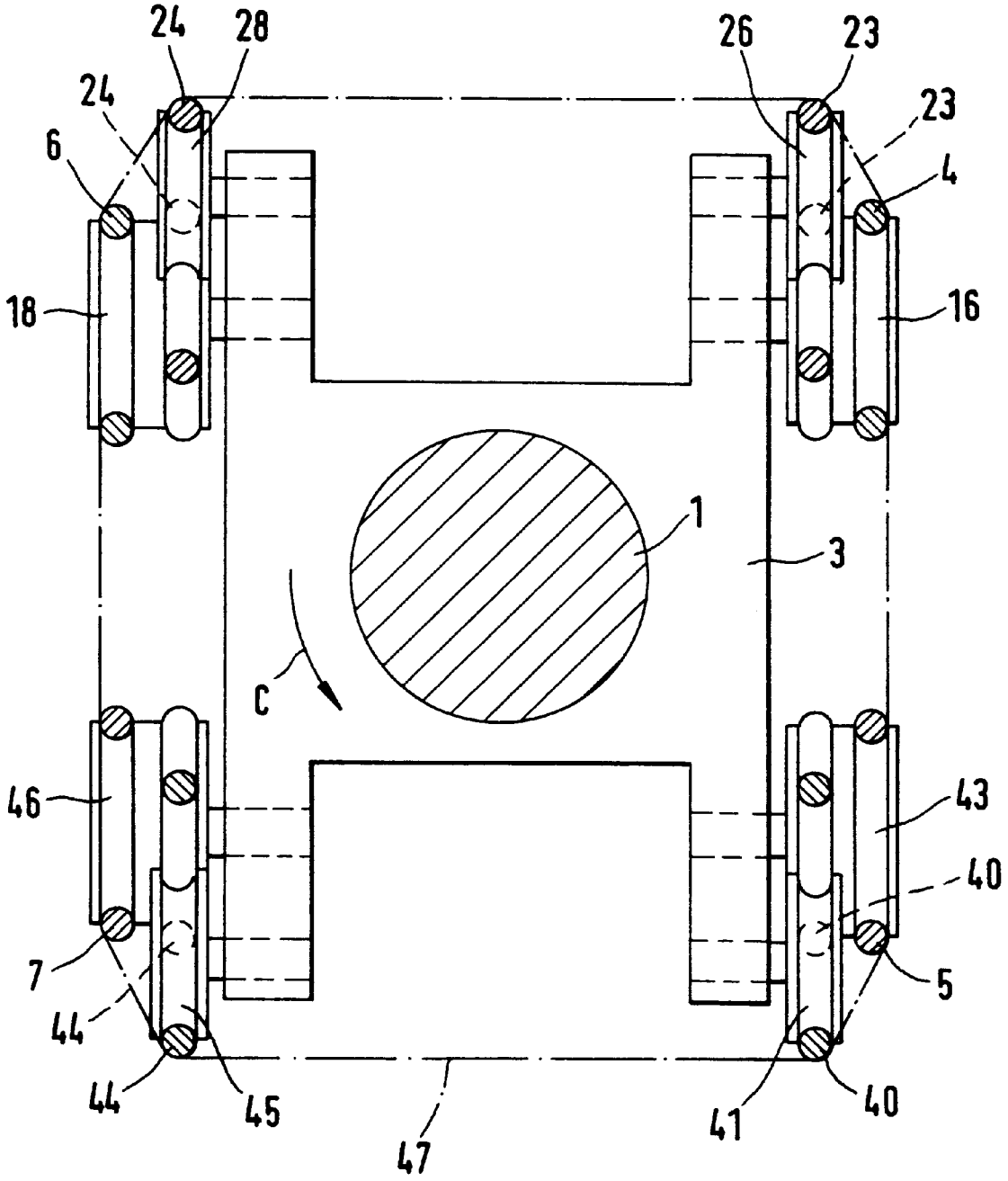
FIG. 6 is a cross section of the arrangement along the sectional plane VI—VI of FIG. 5.

While the arrangement of the auxiliary belts according to FIGS. 2 and 3 is to be preferred when the central mast 1 is not rotatable, an embodiment according to FIGS. 5 and 6 is advantageously chosen in the case of a rotatable central mast 1.

The embodiment according to FIGS. 5 and 6 differs from the above described embodiment in that in addition to the upper auxiliary belts 23 and 24, lower auxiliary belts 40 and 44 are now provided. This results in a better symmetry in the case of the rotational movement of the central mast 1 with regard to the enlarged polygon 47, see especially FIG. 6. Instead of the previous guiding rollers 17 and 19, guiding rollers 43 and 46, similar to the guiding rollers 16 and 18, are applied, which guide, in addition to the transport belts 5 and 7, also the auxiliary belts 40 and 44. Furthermore, further guiding rollers 41,42 and 45 are provided for the auxiliary belts 40 and 44.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for transporting yarn through a heat setting chamber comprising a rotatably driven central mast which is fitted with a plurality of transport belts arranged in cross section around the central mast in the form of a polygon, the transport belts being driven in a transport direction into the heat setting chamber, around which transport belts at least one yarn is wound in ordered loops by means of a winding flyer, which loops have a larger circumference for the purpose of forming a shrinkage reserve than that of the polygon formed by the transport belts, wherein in the area of the winding flyer, auxiliary belts, ending upstream of the heat setting chamber, are arranged adjacent to the transport belts, the speed of said auxiliary belts corresponding to the speed of the transport belts, said auxiliary belts enlarging the polygon by the desired amount to form the shrinkage reserve;

wherein driven guiding rollers are arranged at the transport belts, said guiding rollers also driving the auxiliary belts; and wherein the guiding rollers are arranged at a housing which is rotatable around the axis of the central mast.

2. An arrangement according to claim 1, wherein a planetary gearing is arranged at the housing.

3. An arrangement according to claim 2, wherein the planetary gearing operates with flat belts.

4. A method of making yarn including heat setting the yarn using the arrangement of claim 1.

5. A method of making yarn including heat setting the yarn using the arrangement of claim 2.

6. A method of making yarn including heat setting the yarn is using the arrangement of claim 3.

7. An arrangement for continuous processing of yarns, comprising:

a processing chamber, a central mast extending through at least a portion of the processing chamber, a plurality of circulating main transport belts carried by the central mast and forming yarn support runs extending longitudinally of the central mast through at least a portion of the processing chamber, said main transport belts forming corners of a main transport belt polygonal form, a plurality of circulating auxiliary transport belts disposed upstream of the processing chamber and forming yarn support runs extending longitudinally of the central mast, said auxiliary transport belts forming corners of an auxiliary transport belt polygonal form, a winder operable to wind yarn in controlled yarn loops around the auxiliary transport belts, an auxiliary transport belt drive operable to drive the auxiliary transport belts to thereby transport the yarn loops from the winder to the main transport belts, and a main transport belt drive operable to drive the main transport belts to thereby further transport the yarn loops received from the auxiliary transport belts through at least portions of the processing chamber, wherein the auxiliary transport belt polygonal form is larger than the main transport belt polygonal form to thereby form a shrinkage reserve in the yarn loops.

8. An arrangement according to claim 7, wherein the processing chamber is a heat setting chamber supplied with superheated steam.

9. An arrangement according to claim 7, wherein said auxiliary transport belt drive and said main transport belt are operable to drive said auxiliary and main transport belts at substantially the same yarn transport speed.

10. An arrangement according to claim 9, wherein said auxiliary and main transport drives include commonly driven guiding rollers.

11. An arrangement according to claim 10, wherein said driven guiding rollers are supported at a housing which supports the central mast and is rotatable about the longitudinal axis of the central mast during yarn processing operations.

12. An arrangement according to claim 11, wherein the housing is rotatably drivingly connected with a drive for the winder.

13. An arrangement according to claim 12, wherein flat driving belts drivingly connect the housing with the drive for the winder.

14. An arrangement according to claim 13, wherein the processing chamber is a heat setting chamber supplied with superheated steam.

15. An arrangement according to claim 11, wherein the processing chamber is a heat setting chamber supplied with superheated steam.

16. A method of making textured yarn, including processing yarn in the arrangement of claim 7.

17. A method of making textured yarn, including processing yarn in the arrangement of claim 8.

18. A method of making textured yarn, including processing yarn in the arrangement of claim 11.

19. A method of making textured yarn, including processing yarn in the arrangement of claim 13.

20. A method of making textured yarn, including processing yarn in the arrangement of claim 14.

21. A method of making textured yarn, including processing yarn in the arrangement of claim 15.

22. An arrangement for continuous processing of yarns, comprising:

a processing chamber, a central mast extending through at least a portion of the processing chamber, a plurality of circulating main transport belts carried by the central mast and forming yarn support runs extending longitudinally of the central mast through at least a portion of the processing chamber, said main transport belts forming corners of a main transport belt polygonal form, a plurality of circulating auxiliary transport belts disposed upstream of the processing chamber and forming yarn support runs extending longitudinally of the central mast, a winder operable to wind yarn in controlled yarn loops around the transport belts, and a transport belt drive operable to drive the transport belts to thereby transport the yarn loops from the winder into the processing chamber, wherein at least portions of the auxiliary transport belt yarn support runs are disposed outside of the main transport belt polygonal form to thereby form a shrinkage reserve in the yarn loops.

23. An arrangement according to claim 22, wherein upstream ends of both the main transport belts and the auxiliary transport belts are supported at respective common guiding rollers.

24. An arrangement according to claim 23, wherein said common guiding rollers are driven by the transport belt drive.

25. An arrangement according to claim 24, wherein said central mast is rotatably driven during transport of the yarn loops.

26. An arrangement according to claim 24, wherein said central mast is rotatably fixed during transport of the yarn loops.

27. An arrangement according to claim 23, wherein auxiliary belt support guiding rollers at downstream ends of the yarn support runs of the auxiliary transport belts form an auxiliary transport belt polygonal form which is larger than the main transport belt polygonal form to thereby form the shrinkage reserve on the yarn loops, said yarn loops being transferred from the downstream ends of the auxiliary transport belts to the main transport belts during transport of the yarn loops.

28. An arrangement according to claim 27, wherein auxiliary belt support guiding rollers at downstream ends of the yarn support runs of the auxiliary transport belts form an auxiliary transport belt polygonal form which is larger than the main transport belt polygonal form to thereby form the shrinkage reserve on the yarn loops, said yarn loops being transferred from the downstream ends of the auxiliary transport belts to the main transport belts during transport of the yarn loops.

29. An arrangement according to claim 28, wherein said central mast is rotatably driven during transport of the yarn loops.

30. An arrangement according to claim 28, wherein said central mast is rotatably fixed during transport of the yarn loops.

31. An arrangement according to claim 27, wherein said central mast is rotatably driven during transport of the yarn loops.

32. An arrangement according to claim 27, wherein said central mast is rotatably fixed during transport of the yarn loops.

33. An arrangement according to claim 23, wherein said central mast is rotatably driven during transport of the yarn loops.

34. An arrangement according to claim 22, wherein said central mast is rotatably driven during transport of the yarn loops.

35. An arrangement according to claim 22, wherein said central mast is rotatably fixed during transport of the yarn loops.

36. A method of making yarn including heat setting the yarn using the arrangement of claim 22.

37. A method of making yarn including heat setting the yarn using the arrangement of claim 27.

38. A method of making yarn including heat setting the yarn using the arrangement of claim 28.

39. A method of making yarn including heat setting the yarn using the arrangement of claim 34.

40. A method of making yarn including heat setting the yarn using the arrangement of claim 35.

* * * * *